US007528700B2

(12) United States Patent
Picard et al.

(10) Patent No.: US 7,528,700 B2
(45) Date of Patent: May 5, 2009

(54) INTEGRATED FIRE EXIT ALERT SYSTEM

(75) Inventors: Daniel J. Picard, Oakville, CT (US); Jon Hulse, Wethersfield, CT (US); Jay Krajewski, Coventry, CT (US)

(73) Assignee: Sargent Manufacturing Company, New Haven, CT (US)

( * ) Notice: Subject to any disclaimer, the term of this patent is extended or adjusted under 35 U.S.C. 154(b) by 0 days.

(21) Appl. No.: 11/754,666

(22) Filed: May 29, 2007

(65) Prior Publication Data

US 2007/0222626 A1 Sep. 27, 2007

Related U.S. Application Data

(63) Continuation of application No. 10/785,586, filed on Feb. 23, 2004, now abandoned.

(51) Int. Cl.
*G08B 17/00* (2006.01)

(52) U.S. Cl. ..... 340/286.05; 340/628; 340/577; 340/332

(58) Field of Classification Search ..... 340/286.05, 340/628, 627, 577, 578, 579, 332, 699.6
See application file for complete search history.

(56) References Cited

U.S. PATENT DOCUMENTS 3,827,038 A 7/1974 Willis
3,969,720 A 7/1976 Nishino
4,052,720 A * 10/1977 McGregor et al. ..... 340/522
4,148,023 A 4/1979 Elkin
4,274,084 A * 6/1981 Haus ..... 340/326
4,328,485 A * 5/1982 Potter ..... 340/384.6
4,422,069 A * 12/1983 Edstrom et al. ..... 340/691.1
4,453,222 A * 6/1984 Goszyk ..... 704/274
4,531,114 A * 7/1985 Topol et al. ..... 340/539.1
4,631,528 A 12/1986 Handel et al.
4,649,376 A 3/1987 Frank
4,816,809 A 3/1989 Kim
5,140,301 A * 8/1992 Watanabe ..... 340/332
5,291,183 A 3/1994 Chiang
5,446,440 A * 8/1995 Gleason et al. ..... 340/331
5,642,092 A * 6/1997 Dunne et al. ..... 340/326

(Continued)

FOREIGN PATENT DOCUMENTS

GB 2238412 A 5/1991

(Continued)

*Primary Examiner*—Toan N Pham
*Assistant Examiner*—Travis R Hunnings
(74) *Attorney, Agent, or Firm*—DeLio & Peterson, LLC

(57) ABSTRACT

A fire exit alert system, preferably integrated into an exit device or automatic fire exit door closer, uses sound and light to signal the location of a fire exit in darkness and smoke-obscured rooms. The alert system includes a voice signal, such as "EXIT LOCATED HERE," to signal that the location of the voice is also the location of the exit. A white noise signal generator is used to supplement the voice signal and produces a sound that is particularly localizable by the human ear. A strobe light and a laser are used to produce a visual guide to the location of the exit. The strobe light is flashed when the word "HERE" is used in the voice signal. The laser is used to produce a cone of light that points towards the fire exit alert system.

22 Claims, 3 Drawing Sheets

U.S. PATENT DOCUMENTS 5,724,020 A 3/1998 Hsu
5,816,017 A * 10/1998 Hunt et al. ..... 52/784.11
5,973,603 A 10/1999 Judy
5,990,796 A 11/1999 Hsu
6,150,943 A * 11/2000 Lehman et al. ..... 340/628
6,181,251 B1 * 1/2001 Kelly ..... 340/628
6,249,221 B1 6/2001 Reed
6,323,780 B1 11/2001 Morris
6,522,248 B1 * 2/2003 Andres et al. ..... 340/521
6,639,512 B1 * 10/2003 Lee et al. ..... 340/438
6,859,145 B2 * 2/2005 Wilker et al. ..... 340/693.5
2001/0043144 A1 11/2001 Morris

FOREIGN PATENT DOCUMENTS

WO WO2004092519 A1 10/2004

* cited by examiner

INTEGRATED FIRE EXIT ALERT SYSTEM

BACKGROUND OF THE INVENTION

1. Field of the Invention

The present invention relates to fire exit alert systems and fire exit door hardware. More specifically, the present invention relates to fire exit door hardware containing an integrated fire exit alert system that signals the location of a fire exit with sound and light.

2. Description of Related Art

Although fire codes typically require multiple fire exits for public buildings with large capacity rooms, lives continue to be lost in fires even when there appear to be a sufficient number of available fire exits. A major problem is the tendency for the public to attempt to exit through the same door used to enter the building. Fire codes attempt to solve this problem by requiring fire exits to be clearly marked as exits, however the markings can quickly become obstructed by smoke in the event of fire. When fire or a panicked crowd blocks the original entrance, and smoke obscures the required exit door signage, major loss of life can occur even in a building that meets applicable fire codes and has multiple available alternative fire exits. There exists a need for an improved fire exit alert system to quickly direct the public to fire exits in a heavily smoke-obscured environment.

In addition to required illuminated fire exit signage, fire and building codes applicable to public buildings may require or permit other types of fire exit door hardware. These include exit devices that retract a latch and open the fire exit door when an outward pressure is applied to a push plate or push bar and automatic door closers that act to limit the spread of fire and smoke when the exit door is not in use. There also exists a need for a fire exit alert system that is integrated into a conventional type of fire exit door hardware. Such an integrated design offers reduced installation and manufacturing costs as compared to separate systems.

Bearing in mind the problems and deficiencies of the prior art, it is therefore an object of the present invention to provide a fire exit alert system that can direct the public to available fire exit doors by sound in the presence of smoke.

It is another object of the present invention to provide a fire exit alert system integrated with another type of fire exit door hardware.

A further object of the invention is to provide a fire exit alert system that coordinates sound and light to direct the public to available fire exit doors.

Still other objects and advantages of the invention will in part be obvious and will in part be apparent from the specification.

SUMMARY OF THE INVENTION

The above and other objects, which will be apparent to those skilled in art, are achieved in the present invention which is directed to a fire exit alert system having a control circuit including a storage element, a trigger input, a speaker output, and a light source output. A voice signal is stored in the storage element and the voice signal includes words or a phrase such as "EXIT LOCATED HERE" that indicate the source of the voice signal is an exit.

A speaker is connected to the speaker output of the control circuit for broadcasting an audibly locatable signal, comprising at least the voice signal. In the preferred embodiment of the invention a white noise signal generator is also included and produces an audible multiple frequency signal that can easily be directionally located to further assist in directing the public to the source of the sound signal. The white noise localizable sound signal is preferably cut during the voice signal.

A light source such as a strobe light, laser or high power light emitting diode is connected to the light source output to provide a visually locatable indication of the location of the fire exit alert system. The control circuit turns on the light source, retrieves the voice signal from the storage element and repeatedly sends the voice signal to the speaker output upon receipt of a fire detection signal at the trigger input. The light source is preferably flashed or otherwise modulated when the word "HERE" (or its equivalent) in the voice signal is being transmitted through the speaker to emphasize that the sound emanates from an available emergency exit.

In the most highly preferred embodiment of the invention, the fire exit alert system is integrated into another type of fire exit door hardware, such as an exit device, an automatic door closer or an emergency exit illuminated sign.

A second light source output may be provided and connected to a laser that produces a cone of light having its apex at the emergency exit.

The cone of laser light produces the appearance of a three-dimensional arrowhead pointed towards the emergency fire exit where the invention is located.

A battery backup is provided in case power is lost, and an optional smoke, heat or fire detector can be added to produce a system that will trigger automatically when smoke or fire is detected. Alternatively, the fire exit alert system may be triggered by an external fire alarm system. An output is provided to signal other fire exit alert systems to begin operation so that all exit doors are triggered together.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-4 of the drawings in which like numerals refer to like features of the invention.

Figure 1:
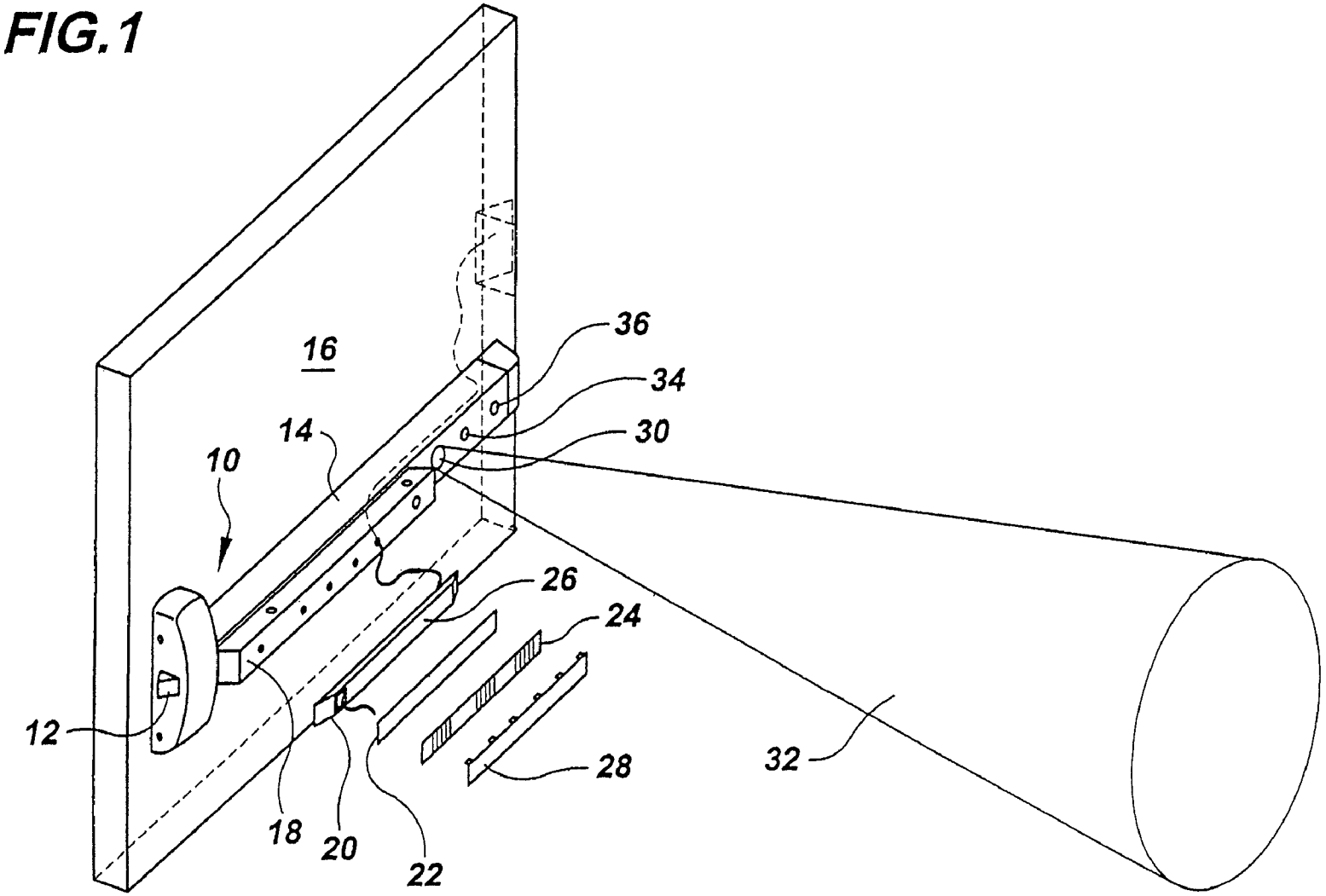
FIG. 1 is a perspective exploded view of a fire exit alert system according to the present invention integrated into an exit device having an illuminated exit sign. The invention is illustrated in the ON state and a portion of an exit door is shown with an electric hinge providing power through the hinge line of the exit door.

Referring to FIG. 1, a first embodiment of the present invention includes an exit device 10 having a latch 12 and a case 14 mounted on a fire exit door 16. A pushbar 18 operates conventionally to retract the latch 12 and open the exit door 16 when pressure is applied to the pushbar. A touchpad 20 is mounted on the pushbar and includes an integrated electroluminescent flat panel illuminator 22, and an exit sign 24. The illuminator 22 and exit sign 24 are held in a recess 26 in the touchpad by a transparent cover 28.

Figure 2:
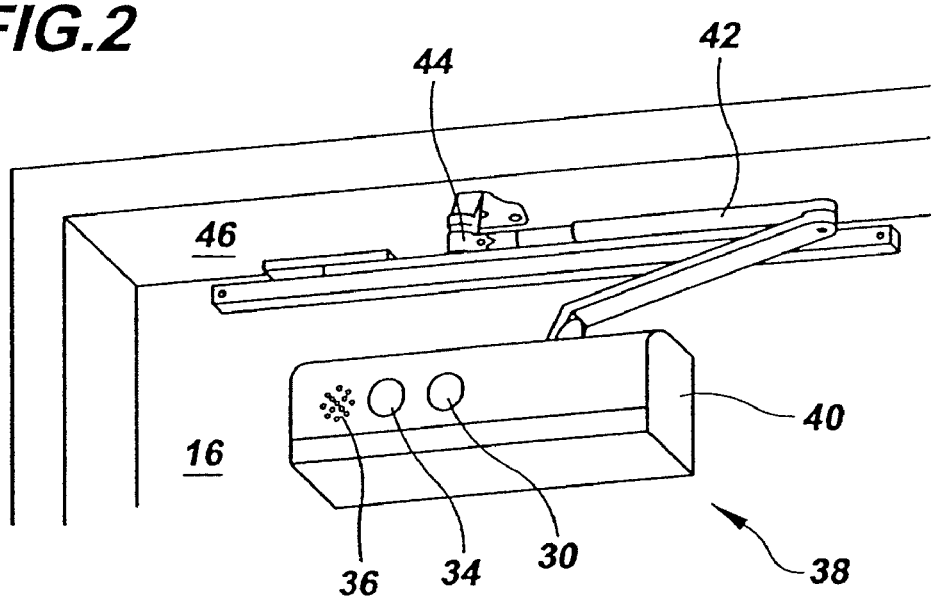
FIG. 2 is a perspective view of a fire exit alert system according to the present invention integrated into an automatic door closer. The invention is illustrated in the OFF state.

A fire exit alert system (see FIG. 4) is integrated into the exit device 10 and is mounted inside the case 14. The fire exit alert system includes a laser 30 producing a conical beam 32, a strobe light 34 and a speaker 36. FIG. 2 illustrates a second embodiment of the present invention in which the fire exit alert system is installed in the case 40 of an automatic door closer 38. The case 40 is attached to the fire exit door 16 and an actuating arm 42 is connected at an end 44 to the fire exit doorframe 46.

Figure 3:
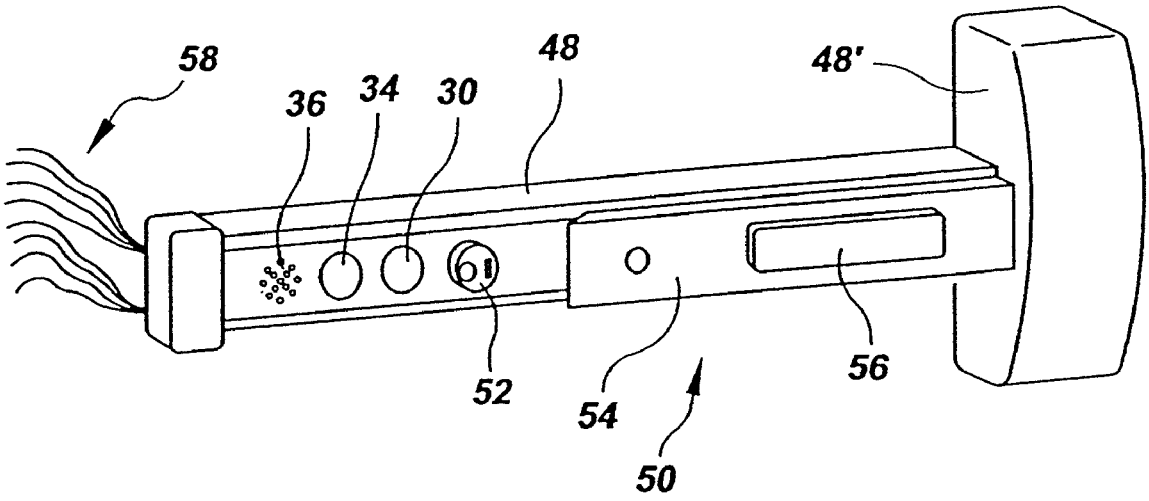
FIG. 3 is a perspective view of a third embodiment of the present invention showing the fire exit alert system integrated into an exit device without an illuminated exit sign.

FIG. 3 shows a third embodiment of the present invention in which the fire exit alert system is installed in the case 48 of an exit device 50 that is substantially similar to the exit device 10 in FIG. 1, except that the device omits the optional illuminated exit sign and a lock cylinder 52 is provided for resetting the fire exit alert system after it has been activated. The exit device 50 includes a pushbar 54 and touchpad 56 that operate conventionally to withdraw a latch (not shown) into the larger end 48' of the case 48. Wiring 58 connects to the fire exit alert system inside the door hardware case and allows the connection of power and a remote fire detection system to the system.

Figure 4:
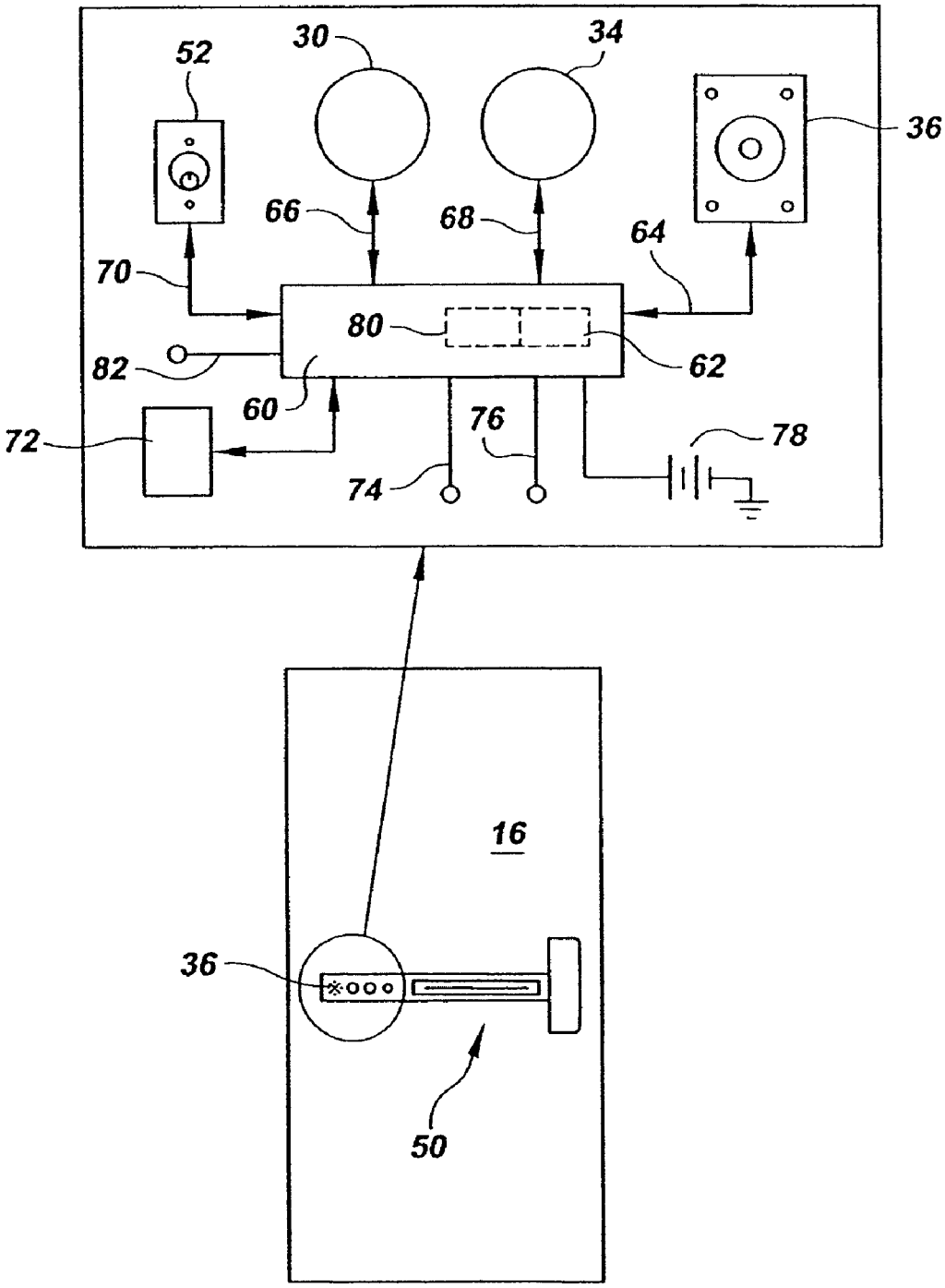
FIG. 4 is a block diagram of the control circuit for the fire exit alert system according to the present invention.

Referring to FIG. 4, the fire exit alert system includes a control circuit 60 including a storage element 62 that stores a voice signal. The voice signal is typically a recorded or simulated voice saying "EXIT LOCATED HERE," "EXIT HERE" or some other words or phrase that indicates to the public that the location from which the voice signal originates is an exit. An important feature of the voice signal is that it clearly instructs the public that the source of the voice signal is an exit. Preferably the instruction will include the word "HERE" or it's equivalent in the appropriate language. Although alarm systems with voice instructions advising the public to proceed to an exit are generally known, such instructions are insufficient to instruct the public as to the exact location of the exit. Even where the voice instructions emanate from a device situated at an exit, unless suitable wording is used indicating that the source of the voice signal is an exit, the public will be unable to locate the exit by sound in a smoke-obscured building.

The storage element 62 in the alert system is preferably a digital storage, and may be flash memory, read only memory, or another known form of digital or analog storage suitable for storing a voice signal. The storage selected is preferably one that retains the signal when power is removed. The memory may be a true storage of the voice signal, or it may comprise instructions for creating a synthetic voice comprising the desired wording. The voice signal may be in any language and may repeat the words in multiple different languages suitable for the country or region where the fire exit alert system is to be installed.

The control circuit 60 includes a speaker output 64 connected to the speaker 36 and first 66 and second 68 light source outputs connected to the laser 30 and the strobe light 34. A reset input is connected to a reset switch that is preferably key controlled, such as lock cylinder 52. An optional smoke or fire detector 72 may be used to trigger the alert system or an external fire detection system may supply a fire detection signal to trigger input 74. The control circuit may be externally powered via power input 76 and a battery backup 78 is preferably provided to operate the alert system in case power is lost.

In addition to the stored voice signal, the fire exit alert system optionally includes a white noise signal generator 80. When the fire exit alert system is triggered, the white noise signal is fed to the speaker in addition to the voice signal. The two audio signals are preferably alternated, however, the white noise signal may also be played continuously, either at a constant volume (preferably less than that of the voice signal) or at a volume that is lowered when the voice signal is played.

The white noise sound includes many different sound frequencies, which makes such a sound particularly easy for a human to directionally locate. In a smoke-obscured room the white noise signal acts to guide the public to the exit by sound even when visual signals and signs cannot be seen. The localizable nature of the voice and/or audible white noise signals, coupled with the instructions of the wording in the voice signal, cooperate to guide the public to the exit in fire situations where prior art alert systems and alarms have failed.

Although prior art alarm systems have been provided with various types of bells or horns, the relatively constant frequency of such alarms makes them significantly harder to locate than a white noise signal. Moreover, without the voice signal of the present invention, the public has no way of knowing whether such a prior art alarm is located near an exit or is merely signaling the existence of fire or smoke.

To assist in locating the exit, the alert system is also provided with a light source. In one embodiment of the invention, the light source comprises a strobe light. The strobe light is flashed (or turned on) by the control circuit at the moment that the voice signal reaches the word "HERE" (or its equivalent). The flash or additional illumination that occurs with the word "HERE" emphasizes that the sound is coming from an available exit. This coordinated voice and light is particularly effective in providing the necessary information to the public during emergency conditions that they may proceed to the source of the sound. Even where the strobe light is partially obscured, the emitted light will be scattered to produce a region of illuminated smoke that emphasizes the sound in the manner described. The strobe light may comprise any type of lighting that can be flashed or turned on and off to produce the desired visual emphasis.

In the most highly preferred design of the invention, a laser 30 is used to produce a cone of light. Such a cone is particularly visible in the initial stages of a fire where smoke particles have just begun to enter the occupied area to be evacuated. The cone produced has an apex at the fire exit alert system and produces the appearance of a three-dimensional arrowhead that points towards the fire exit and provides a visual direction guide towards the exit.

The cone preferably has an apex angle of about 15 degrees, although other angles may be used. Laser devices that produce a suitable cone are readily available. The control circuit, speaker, light sources and other elements of this invention are preferably housed in the case of some type of known fire exit door hardware. Such hardware includes exit devices, latches and lock mechanisms, automatic door closers, illuminated emergency fire exit signs and other hardware typically used on or in connection with a fire exit door. This approach produces an integrated product that can be installed almost as easily as the hardware alone, and is less expensive to manufacture than separate components. Nonetheless, the alert system may, if desired, be installed in a non-integrated standalone case for use on a fire exit door with conventional fire exit door hardware.

The light sources may be installed behind glass lenses that are flush with the case, as illustrated, or behind mesh openings. Alternatively, they may be surface mounted externally.

Other forms of laser motion, modulation of color, direction and beam shape are also contemplated in this invention, as well as coordination with the voice signal. Lasers may be used alone to form beams or as a form of strobe illumination or in conjunction with conventional strobe light flash tubes, bright light emitting diodes, or incandescent lighting.

The system may be hard-wired into the emergency system, or wireless connection methods may be used for triggering and for the other inputs and outputs described above.

The system may be triggered by a remote fire detection signal produced by any conventional fire system via trigger input 74, or by the optional smoke or fire detection system 72. Once the system has been triggered, an optional trigger output 82 may be used to signal to other fire exit alert systems or to any fire detection system that triggering has occurred so that other fire exits may begin to signal their location. To reset the system, a reset signal is applied to reset input 70. The reset may come from a local source, such as lock cylinder 52, or it may come from a remote fire detection and control system which may also control other fire exit alert systems as well as alarms, sprinkler systems, emergency lighting and the like. The system may also be triggered when a fire alarm handle is pulled, when an emergency exit door is opened, when pressure drops in a sprinkler system, etc.

The voice signal is preferably repeated at 3 to 10 second intervals until the system is reset. Volume is typically at least 85 decibels and in the preferred design it is adjustable up to 125 decibels.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A fire exit alert system for operating a fire door, alerting members of the general public during a fire and assisting members of the general public in visually and audibly locating the fire exit door during a fire emergency, the fire exit alert system comprising:

fire exit door hardware for operating, locking, latching, unlocking, unlatching, opening, or closing the fire exit door, the fire exit door hardware being mounted in contact with the fire exit door to operate the fire exit door, the fire exit door hardware including a case;

a control circuit mounted in the fire exit door hardware case, the control circuit including:

a voice storage element for storing a pre-recorded voice signal co-located with the fire exit door hardware, the voice signal to be audibly broadcast from a location corresponding to the fire exit door hardware, the voice signal including words indicating to members of the general public who have not previously used the fire exit door that an exit is located at the location from which the voice signal is being broadcast;

a trigger input adapted for receiving a fire detection signal from a fire detection system;

a speaker output; and a light source output;

a speaker connected to the speaker output of the control circuit for broadcasting an audibly locatable signal, the audibly locatable signal comprising at least the pre-recorded voice signal, to indicate that the pre-recorded voice signal is being audibly broadcast from the location of an exit, the pre-recorded voice signal assisting members of the general public who have not previously used the fire exit door to determine that a safe exit is located at the source of the audibly locatable signal; and a light source connected to the light source output for providing a visually locatable indication of the location of the fire exit door to members of the general public;

the control circuit turning on the light source, retrieving the voice signal from the voice storage element and repeatedly sending the voice signal to the speaker output upon receipt of the fire detection signal indicating a fire emergency;

the fire exit door hardware acting to operate, lock, latch, unlock, unlatch, open, or close the fire exit door in the absence of a fire emergency.

2. The fire exit alert system of claim 1 wherein the control circuit coordinates the repeated voice signal and the light source by flashing the light source when the voice signal is indicating in words that the voice signal is being broadcast from the location of an exit.

3. The fire exit alert system of claim 1 wherein the voice signal includes the word "HERE" to indicate that the source of the voice signal is an exit, and the control circuit coordinates the repeated voice signal and the light source by flashing the light source when the word "HERE" is sent to the speaker output.

4. The fire exit alert system of claim 1 wherein the light source is a strobe light and wherein the control circuit coordinates the repeated voice signal and the light source by flashing the strobe light at the moment the voice signal is indicating that the source of the voice signal is an exit.

5. The fire exit alert system of claim 1 wherein the light source is a laser.

6. The fire exit alert system of claim 5 wherein the laser produces a cone having an apex at the fire exit alert system to provide a visual direction guide towards the fire exit alert system.

7. The fire exit alert system of claim 1 wherein the light source is a strobe light and the fire exit alert system further includes a second light source comprising a laser.

8. The fire exit alert system of claim 7 wherein the control circuit coordinates the repeated voice signal and at least one of the light sources by activating at least one of the light sources when the voice signal is indicating that the source of the voice signal is an exit.

9. The fire exit alert system of claim 7 wherein the control circuit coordinates the repeated voice signal and the strobe light by flashing the strobe light when the voice signal is indicating that the source of the voice signal is an exit.

10. The fire exit alert system of claim 1 wherein the control circuit further includes an audio signal generator for generating an audible signal previously determined to be easily directionally and audibly locatable, the audio signal generator comprising a white noise signal generator producing a white noise signal, the control circuit sending the white noise signal to the speaker output to produce an additional audibly locatable signal.

11. The fire exit alert system of claim 10 wherein the control circuit alternately sends the white noise signal and the voice signal to the speaker output.

12. The fire exit alert system of claim 1 wherein the fire exit door hardware comprises an exit device having a latch for engaging a door frame of a fire exit door.

13. The fire exit alert system of claim 1 wherein the fire exit door hardware comprises an automatic door closer.

14. The fire exit alert system of claim 1 wherein the control circuit further includes a reset input for receiving a reset signal, the control circuit turning off the light source and the speaker output upon receipt of the reset signal.

15. The fire exit alert system of claim 1 further including a backup battery for powering the fire exit alert system during a power failure.

16. The fire exit alert system of claim 1 further including a smoke detector connected to the trigger input of the control circuit.

17. The fire exit alert system of claim 1 further including a heat detector connected to the trigger input of the control circuit.

18. The fire exit alert system of claim 1 further including an illuminated exit sign.

19. The fire exit alert system of claim 18 where in the illuminated exit sign comprises an electroluminescent illuminated exit sign.

20. A fire exit alert system for operating a fire door, alerting members of the general public during a fire and assisting members of the general public in visually and audibly locating the fire exit door during a fire emergency, the fire exit alert system comprising:

an exit device for a fire exit door, the exit device being mounted on the fire door and engaging a door frame of the fire door, the exit device having a case;

a control circuit mounted in the exit device case, the control circuit including:

a voice storage element for storing a pre-recorded voice signal co-located with the fire exit door hardware, the voice signal to be audibly broadcast from a location corresponding to the fire exit door hardware, the voice signal including words indicating to members of the general public who have not previously used the fire exit door that an exit is located at the location from which the voice signal is being broadcast;

a trigger input adapted for receiving a fire detection signal from a fire detection system;

a white noise signal generator for producing a white noise signal having audible frequencies previously determined to be audibly locatable by members of the general public;

a speaker output; and first and second light source outputs;

a speaker connected to the speaker output of the control circuit for repeatedly broadcasting the pre-recorded voice signal and the white noise signal to provide an audible direction guide towards the fire exit alert system;

a strobe light connected to the first light source output; and a laser connected to the second light source output, the laser producing a cone having an apex at the fire exit alert system to provide a visual direction guide towards the fire exit alert system;

the control circuit flashing the strobe light in coordination with the voice signal.

21. A fire exit alert system for operating a fire door, alerting members of the general public during a fire and assisting members of the general public in visually and audibly locating the fire exit door during a fire emergency, the fire exit alert system comprising:

an automatic door closer for a fire exit door, the automatic door closer being mounted above the fire exit door and having an arm extending into contact with the fire exit door for closing the fire exit door, the automatic door closer having a case;

a control circuit mounted in the automatic door closer case, the control circuit including:

a voice storage element for storing a pre-recorded voice signal co-located with the fire exit door hardware, the voice signal to be audibly broadcast from a location corresponding to the fire exit door hardware, the voice signal including words indicating to members of the general public who have not previously used the fire exit door that an exit is located at the location from which the voice signal is being broadcast;

a trigger input adapted for receiving a fire detection signal from a fire detection system;

a white noise signal generator for producing a white noise signal having audible frequencies previously determined to be audibly locatable by members of the general public;

a speaker output; and first and second light source outputs;

a speaker connected to the speaker output of the control circuit for repeatedly broadcasting the voice signal and the white noise signal to provide an audible direction guide towards the fire exit alert system;

a strobe light connected to the first light source output; and a laser connected to the second light source output, the laser producing a cone having an apex at the fire exit alert system to provide a visual direction guide towards the fire exit alert system;

the control circuit flashing the strobe light in coordination with the voice signal.

22. A method of operating a fire door, alerting members of the general public during a fire and assisting members of the general public in visually and audibly locating the fire exit door during a fire emergency, the method comprising the steps of:

providing fire exit door hardware for operating, locking, latching, unlocking, unlatching, opening, or closing the fire exit door, the fire exit door hardware being adapted for mounting in contact with the fire exit door to operate the fire exit door, the fire exit door hardware including a case;

providing a control circuit mounted in the fire exit door hardware case, the control circuit including:

a voice storage element for storing a pre-recorded voice signal co-located with the fire exit door hardware, the voice signal to be audibly broadcast from a location corresponding to the fire exit door hardware, the voice signal including words indicating to members of the general public who have not previously used the fire exit door that an exit is located at the location from which the voice signal is being broadcast;

a trigger input adapted for receiving a fire detection signal from a fire detection system;

a speaker output; and a light source output;

providing a speaker connected to the speaker output of the control circuit for broadcasting an audibly locatable signal, the audibly locatable signal comprising at least the pre-recorded voice signal, to indicate to members of the general public that the prerecorded voice signal is being audibly broadcast from the location of an exit, the pre-recorded voice signal assisting members of the general public who have not previously used the fire exit door to determine that a safe exit is located at the source of the audibly locatable signal;

providing a light source connected to the light source output for providing a visually locatable indication of the location of the fire exit door to members of the general public;

responsive to receipt of the fire detection signal indicating a fire emergency, performing the steps of:

turning on the light source, retrieving the voice signal from the voice storage element; and repeatedly sending the voice signal to the speaker output to broadcast the audibly locatable signal from the speaker and advise members of the general public that the source of the audibly locatable signal is a fire exit.

* * * * *